US007366455B2

(12) United States Patent
Iwasaki et al.

(10) Patent No.: US 7,366,455 B2
(45) Date of Patent: Apr. 29, 2008

(54) IMAGE FIXING APPARATUS WITH HEATER AND HEATER HOLDER CONTACTING THE HEATER

(75) Inventors: Atsushi Iwasaki, Mishima (JP); Hiroaki Sakai, Mishima (JP); Akira Kato, Mishima (JP); Tomoyuki Makihira, Kanagawa-ken (JP); Masafumi Maeda, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 11/213,991

(22) Filed: Aug. 30, 2005

(65) Prior Publication Data

US 2006/0045589 A1 Mar. 2, 2006

(30) Foreign Application Priority Data

Sep. 1, 2004 (JP) ..... 2004-254282

(51) Int. Cl.
*G03G 15/20* (2006.01)

(52) U.S. Cl. ..... 399/329; 219/216

(58) Field of Classification Search ..... 399/69, 399/329, 330; 219/216, 538, 539, 542, 543; 338/311

See application file for complete search history.

(56) References Cited

U.S. PATENT DOCUMENTS

| | | | | |
|---|---|---|---|---|
| 5,682,576 | A | 10/1997 | Sakai et al. | 399/69 |
| 5,819,134 | A | 10/1998 | Sato et al. | 399/69 |
| 5,904,871 | A | 5/1999 | Sakai et al. | 219/216 |
| 6,094,559 | A | 7/2000 | Otsuka et al. | 399/327 |
| 6,151,462 | A | 11/2000 | Fukuzawa et al. | 399/67 |
| 6,175,699 | B1 | 1/2001 | Kato et al. | 399/69 |
| 6,438,348 | B2 | 8/2002 | Kobaru et al. | 399/333 |
| 6,469,279 | B1 * | 10/2002 | Ohtsuka | 219/216 |
| 6,516,165 | B2 | 2/2003 | Makihira et al. | 399/69 |
| 6,583,389 | B2 * | 6/2003 | Murooka et al. | 219/216 |
| 6,587,662 | B2 | 7/2003 | Kobaru et al. | 399/323 |
| 6,734,397 | B2 | 5/2004 | Kato et al. | 219/216 |
| 6,754,458 | B2 | 6/2004 | Makihira | 399/92 |
| 7,027,763 | B2 | 4/2006 | Kato et al. | 399/329 |
| 7,193,181 | B2 * | 3/2007 | Makihira et al. | 219/216 |
| 2003/0077092 | A1 | 4/2003 | Ogawa et al. | 399/328 |

(Continued)

FOREIGN PATENT DOCUMENTS

| | | |
|---|---|---|
| JP | 10-125450 | 5/1998 |

(Continued)

*Primary Examiner*—Robert Beatty
(74) *Attorney, Agent, or Firm*—Fitzpatrick, Cella, Harper & Scinto

(57) ABSTRACT

The image fixing apparatus includes a heater having a heat generating resistor on a substrate, a heater holder for holding said heater, and a backup roller for forming a nip portion in cooperation with said heater, wherein said heater holder has, in a direction along a short side of said heater, a contact area facing said resistor forming area and coming into contact with said heater, and non-contact areas provided on both sides of the contact area and not coming into contact with said heater, and the contact area has a width equal to or larger than the resistor forming area. With this configuration, it is possible to provide the image fixing apparatus capable of restraining a stress applied to the heater and an image heating apparatus capable of restraining a rise in temperature of a sheet non-feeding portion.

6 Claims, 15 Drawing Sheets

U.S. PATENT DOCUMENTS

| | | | | |
|---|---|---|---|---|
| 2004/0131374 | A1 | 7/2004 | Sakai | 399/68 |
| 2004/0202491 | A1 | 10/2004 | Sakai et al. | 399/69 |
| 2005/0185994 | A1 | 8/2005 | Inada et al. | 399/328 |
| 2005/0214044 | A1 | 9/2005 | Sakakibara et al. | 399/333 |
| 2005/0258158 | A1 | 11/2005 | Takami et al. | 219/216 |
| 2005/0280682 | A1 | 12/2005 | Kato et al. | 347/102 |
| 2006/0000819 | A1 | 1/2006 | Makihira et al. | 219/216 |
| 2006/0045589 | A1 | 3/2006 | Iwasaki et al. | 399/328 |
| 2006/0067750 | A1 | 3/2006 | Inoue et al. | 399/328 |

FOREIGN PATENT DOCUMENTS

| | | | |
|---|---|---|---|
| JP | 10-144453 | | 5/1998 |
| JP | 2003282219 | A * | 10/2003 |

* cited by examiner

IMAGE FIXING APPARATUS WITH HEATER AND HEATER HOLDER CONTACTING THE HEATER

BACKGROUND OF THE INVENTION

1. Field of the Invention

The present invention relates to an image fixing apparatus used for an image forming apparatus such as a printer, a copying machine and a facsimile.

2. Description of Related Art

A thermal roller type image fixing apparatus and a film heating type image fixing apparatus have hitherto been known as an image fixing apparatus in the image forming apparatus such as the copying machine and the printer.

In particular, the film heating type image fixing apparatus is, as compared with the thermal roller type image fixing apparatus, effective as an energy saving/on-demand image fixing apparatus capable of restraining an electric power consumption as low as possible without supplying the electric power when in a standby mode.

The image fixing apparatus includes, as a basic configuration, a heating member (heater) constructed of a ceramic substrate, a heat generating resistor (heat generation resistor), etc., a heating member support member for supporting the heating member, a flexible member sliding on the heating member, and a pressuring member press-fitted to the heating member through the flexible member and thus forming a fixing nip, wherein the fixing nip portion nips and conveys a recording material formed with a unfixed image, and the unfixed image is fixed as a permanent image on the recording material by the heat transferred from the heating member via the flexible member. The flexible member involves using a film made of a heat resistive thin resin or a film made of a metal.

FIG. 14 is an enlarged cross-sectional model view of the fixing nip portion in one example of the film heating type image fixing apparatus. A ceramic heating member 73 formed as an elongate thin plate member is depicted in the drawing in FIG. 14, wherein its longitudinal direction is a vertical direction in FIG. 14. The ceramic heating member 73 uses a ceramic substrate made of alumina etc. as a heater substrate, and is a low heat-capacity linear heating member constructed of a ceramic substrate 73*a*, a heat generating resistor 73*b* so provided as to be formed along the longitudinal direction of the ceramic substrate on one-surface side of this ceramic substrate 73*a*, a surface protective layer 73*c* covering a heat generation resistor forming surface side of the ceramic substrate 73*a* and composed of a glass layer, and so on.

The ceramic heating member 73 is fitted into the heating member support member (heater holder) 71 made of a heat resisting resin etc. This heating member support member 71 is provided with a heating member fitting groove portion 711 for fitting the ceramic heating member 73, and the ceramic heating member 73 is fitted into this heating member fitting groove portion 711. The side of the surface protective layer 73*c* of the ceramic heating member 73 is the surface side of the ceramic heating member 73, and the side of surface protective layer 73*c* of the surface thereof faces a nip portion that will be explained later on.

The ceramic heating member 73 is disposed into a film 72 formed as a flexible member. An elastic pressurizing roller 74 serving as a backup roller is disposed oh the side opposite to the ceramic heating member 73 with respect to the film 72. The elastic pressurizing roller 74 has an elastic body layer 74*b*, and an outer peripheral surface of the elastic body layer is covered with a release layer 74*c*. The surface of the ceramic heating member 73 supported on the heating member support member 71 and the pressurizing roller 74 cooperate to form a fixing nip portion N with the film 72 being nipped therebetween. The film 72 is, as the pressurizing roller 74 is rotationally driven or by another film driving means, moved in a direction indicated by an arrowhead while its internal surface comes into contact with the surface of the ceramic heating member 73.

The ceramic heating member 73 rises in temperature quickly on the whole by a heat dissipation by itself from the heat generating resistor due to electric conduction to the heat generating resistor 73*b*. Then, a state of the temperature of the ceramic heating member 73 is detected by temperature detecting means (not shown), and an information of the temperature detected by the temperature detecting means is inputted to temperature control means (not shown) from the temperature detecting unit. The temperature control unit controls the electric power supply to the heat generating resistor 73*b* so that the heating member temperature information inputted from the temperature detecting unit is kept at a predetermined fixing temperature, thus controlling the temperature of the ceramic heating member 73.

A recording material P bearing an unfixed toner image t is passed through the nip portion N of a thus-temperature-controlled fixing unit, whereby the toner image t is fixed by heating onto the recording material P. The symbol A represents a recording material conveyance direction. The recording material P passing through the fixing nip N is curvature-separated from the film surface and is then conveyed.

In the film heating type image fixing apparatus, generally, the ceramic heating member 73 is supported by forming a heating member seating face on the heating member support member 71 and nipping the ceramic heating member 73 between this heating member seating face and the fixing nip portion N.

The following are specific configurations of the seating face.

1) One configuration, as shown in FIG. 14, is that a bottom face of the heating member fitting groove portion 711 of the heating member support member 71 sustains the entire rear surface of the heating member.

2) Another configuration, as shown in FIG. 15, is that the heating member seating face 71*a* sustains only short-directional upstream and downstream sides of the heating member in order to efficiently transfer the heat of the heat generating resistor 73*b* toward the fixing nip N by speeding up a rise in temperature of the ceramic heating member 73 itself, and the heat is cut off by providing an air gap portion 712 between two portions of heating member seating faces 71*a*.

In the case of a printer that outputs the sheets of which the number is not so large per unit time, an amount of electric power supply to the heat generating resistor is small, and hence the configuration shown in FIG. 15 is effective especially in quickly starting up the heating member in an image-fixable state.

In the case of a printer that outputs a large number of sheets per unit time, however, the amount of electric power supply to the heat generating resistor increases. In this type of printer outputting the large number of sheets per unit time, if the electric power supply to the heat generating resistor abruptly increases, a temperature of a portion provided with the heat generating resistor of the heating member sharply rises, and there is a large temperature difference from a portion provided with none of the heat generating resistor of the heating member. It then proves that a stress is applied to the substrate of the heating member due to this temperature difference, with the result that heating member is broken.

For example, if the temperature of the heating member excessively rises due to (thermal) runaway (unable control) of the image fixing apparatus as in the case of a fault of a TRIAC that controls an adjustment of the temperature of the heating member, there is a possibility that the ceramic substrate might be broken before a temperature over-rise preventive element (a temperature fuse, a thermo switch) abutting on the heating member operates.

In the case of the configurations of the conventional heating member, the heating member seating face and the fixing nip in FIGS. 14 and 15, the heat from the heat generating resistor 73*b* transfers toward the fixing nip N, the ceramic heating member 73 itself, and the heating member support member 71 via the heating member seating face 71*a*. In any one of the configurations in FIGS. 14 and 15, however, the heat transfers to the heating member support member 71 from a heating member edge portion provided with none of the heat generating resistor 73*b*, and consequently there increases a temperature difference from a portion (resistor forming area) Wh provided with the heat generating resistor 73*b*. Particularly in the configuration in FIG. 15, the heating member portion corresponding to the air gap portion 712 quickly rises in temperature, however, the heat at a portion abutting on the seating face 71*a* escapes to the heating member support member 71, with the result that a temperature rising speed slows down. Therefore, the temperature difference in an interior of the heating member becomes much larger, and a margin to a damage to the heating member is small because of a large thermal stress. The configuration in FIG. 14 shows a smaller temperature difference within the heating member than in the configuration in FIG. 15, however, the large temperature difference between the resistor forming area Wh and the heat generating resistor non-forming area is still easy to occur.

Further, as disclosed in Japanese Patent Application Laid-Open No. H10-144453 and Japanese Patent Application Laid-Open No. H10-125450, there is proposed a method, wherein as the configuration of the seating face of the heating member support member, a contact area between the heating member and the heating member support member is set as small as possible, there is reduced a temperature difference caused between the area formed with the heat generating resistor of the heating member and the area provided with no heat generating resistor, a margin to the damage to the heating member when running away is increased by reducing the thermal stress applied to within the heating member. If the area of the seating face is decreased, the heat transfer to the heating member support member from the heating member is restrained, and therefore the image fixing apparatus can be also swiftly started up to the image-fixable temperature. FIG. 16 shows the seating face configuration disclosed in Japanese Patent Application Laid-Open No. H10-125450. To be specific, the contact area between the ceramic heating member 73 and the heating member support member 71 is reduced to the greatest possible degree by decreasing a total area of a heating member seating face 71*a* receiving the ceramic heating member 73.

In the image fixing apparatus having the configuration as shown in FIG. 16, however, in the case of feeding a sheet through (which will hereinafter be referred to as a small-sized sheet), which is narrow in width for a width, in a longitudinal direction (a direction orthogonal to a recording material conveyance direction), of the heat generating resistor as in an envelope and a postal card, a temperature of a sheet non-feeding portion that will be mentioned later on rises more greatly than in the conventional configurations in FIGS. 14 and 15.

In the longitudinal direction of the heating member, the heat in the area through which the sheet passes is absorbed by the sheet, and hence the electric power is supplied to the heating member (precisely to the heat generating resistor) to compensate for an amount of heat radiation. A fixing temperature is maintained in the sheet feeding area of the heating member under this type of control. The heat is not, however, absorbed by the sheet in an area through which the sheet does not pass, so that the heat in this area rises higher than the fixing temperature. Such a phenomenon is called a sheet non-feeding portion temperature rise. If an excessive sheet non-feeding portion temperature rise occurs, durability of components building up the image fixing apparatus decline.

As described above, the seating face configuration illustrated in FIG. 16 enables, the stress applied to the heating member when the sheet is not fed through the fixing nip portion, to be restrained to some extent.

However, the rear surface of the heating member is rendered adiabatic by an air layer over a wide range, and hence a function of restraining the sheet non-feeding portion temperature rise when feeding the small-sized sheet through is smaller than in the configurations in FIGS. 14 and 15. Further, in the configuration in FIG. 16, the heat is harder to escape to the heating member support member from the heating member on the whole than in the conventional configurations in FIGS. 14 and 15, however, there is still the large internal temperature difference within the heating member between the resistor forming area Wh of the heating member and the heat generating resistor non-forming area, and the margin to the thermal stress described above is also still insufficient.

SUMMARY OF THE INVENTION

It is an object of the present invention, which was devised in view of the problems described above, to provide an image fixing apparatus capable of restraining a stress applied to a heater.

It is another object of the present invention to provide an image heating apparatus capable of restraining a sheet non-feeding portion temperature rise while retraining the stress applied to the heater.

It is still another object of the present invention to provide an image fixing apparatus comprising a heater having a heat generating resistor on a substrate, a heater holder for holding said heater, and a backup roller for forming a nip portion in cooperation with said heater, wherein said heater holder includes, in a direction along a short side of said heater, a contact area Wg facing said resistor forming area Wh and coming into contact with said heater, and non-contact areas provided on both sides of the contact area and not coming into contact with said heater, and the contact area Wg has a width equal to or larger than the resistor forming area Wh.

Further objects of the present invention will be apparent from reading the following detailed description with reference to the accompanying drawings.

DETAILED DESCRIPTION OF THE PREFERRED EMBODIMENTS

First Example (1) Example of Image Forming Apparatus

Figure 1:
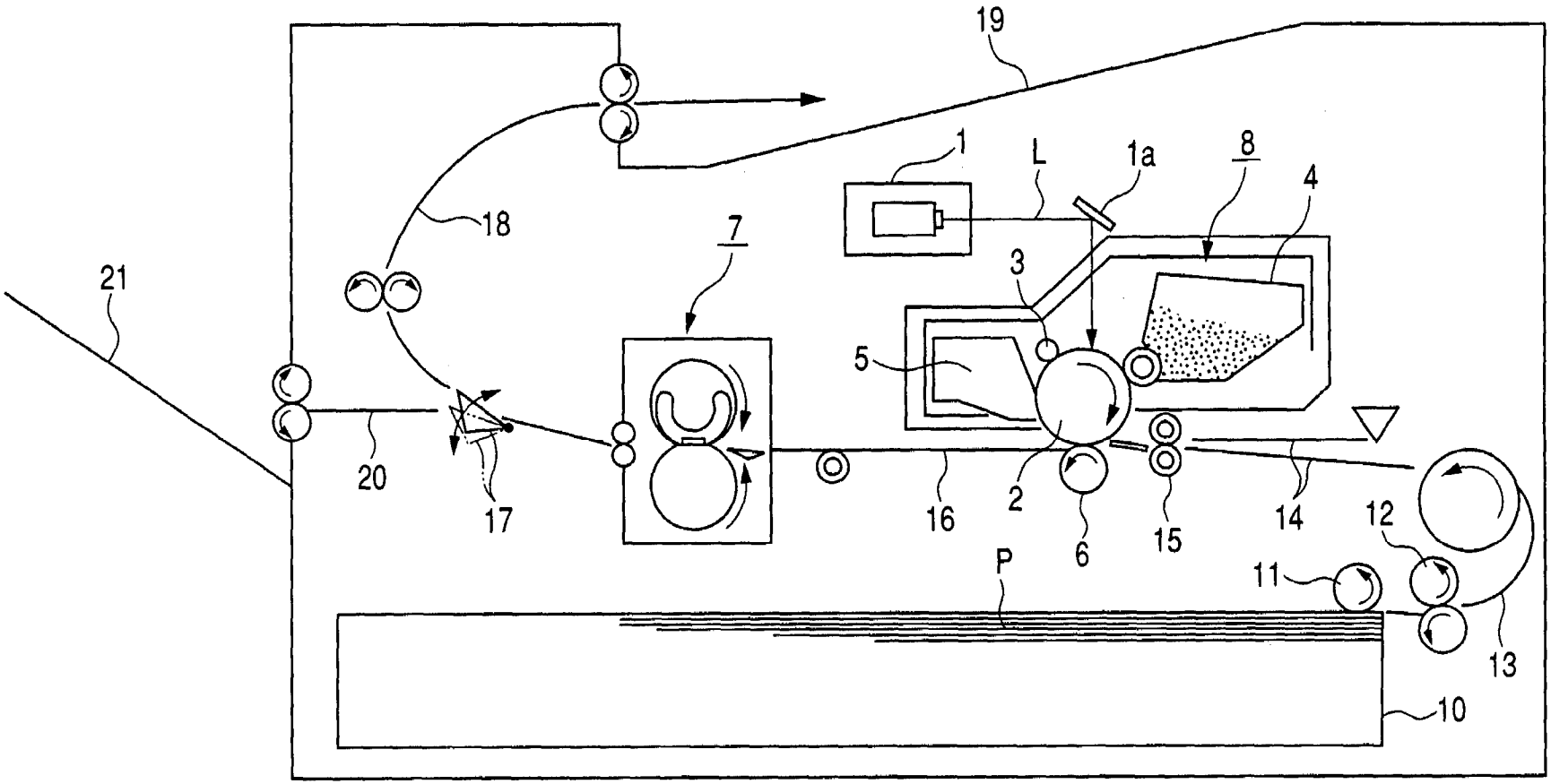
FIG. 1 is a schematic view of a configuration of an image forming apparatus in a first example.

FIG. 1 is a schematic configurational diagram of an example of an image forming apparatus mounted with an image fixing apparatus according to the present invention. The image forming apparatus in this example is a laser beam printer using a transfer type electrophotographic process.

The numeral 1 represents a laser scanner unit that emits a laser beam L corresponding to image information. The symbol 1*a* designates a mirror that reflects the laser beam L toward a photosensitive body 2. The numeral 8 stands for a process cartridge including built-in main image forming units (image forming means) and is constructed of a photosensitive drum (electrophotographic photosensitive body) 2 as an image bearing body, a roller charger 3 formed of a semiconductive rubber, a developing apparatus 4 for developing an image by adhering a toner t to an electrostatic latent image on the photosensitive drum 2, a cleaner 5 for removing a waste toner from on the photosensitive drum 3, and so on. The photosensitive drum 2 within this process cartridges 8 rotates clockwise as indicated by an arrowhead, and the surface of the photosensitive drum 2 is uniformly charged by the roller charger 3. The uniformly-charged surface of the photosensitive drum 2 is irradiated via the mirror 1*a* with the laser beam L emitted from the scanner unit 1, whereby the electrostatic latent image corresponding to the image information is formed on the surface of the photosensitive drum 2. Then, this electrostatic latent image is supplied with the toner t from the developing apparatus 4 and is visualized as a toner image.

On the other hand, recording materials (transfer materials) P in a sheet feeding cassette 10 are fed by a sheet feeding roller 11 while being separated sheet by sheet by a separation roller pair 12. The thus-fed recording material P is reversed at a U-turn sheet path and conveyed along up-and-down guides 14 to a pair of registration rollers 15. The registration rollers 15 stop rotating till the recording material P comes in, and a nip portion thereof receives the recording material P by butting a leading end of the recording material P against the nip portion, thus correcting a skew feed of the recording material P.

Subsequently, the registration rollers 15 convey the recording material P to a transfer portion as an abutting nip portion between the photosensitive drum 2 and the transfer roller 6 so as to synchronize with the leading end of the toner image formed on the photosensitive drum 2.

The recording material P, which has thus been conveyed to the transfer portion, is given from its underside an electric charge exhibiting an opposite polarity to that of the toner from the transfer roller 6, and the toner image formed on the photosensitive drum 2 is transferred onto the recording material P.

The recording material P onto which the toner image has been transferred is conveyed via a conveyance guide 16 to an image fixing apparatus 7. The image fixing apparatus 7 solves and fixes the unfixed toner image on the recording material P onto the recording material P by heat and by a pressure, thereby obtaining a recording image.

The recording material P after being image-fixed is guided toward the U-turn sheet path 18 by a flapper 17 and then discharged onto a first discharge tray 19 when discharge in an image surface downward mode is designated. Further, when the discharge in an image surface upward mode is designated, the recording material P is guided toward a rectilinear sheet path 20 by the flapper 17 and is then discharged onto a second discharge tray 21.

Herein, in the image forming apparatus in the first example, a conveyance reference for the recording material P corresponds with a center of the recording material in an orthogonal direction of the recording material conveyance direction.

(2) Image Fixing Apparatus 7

Figure 2:
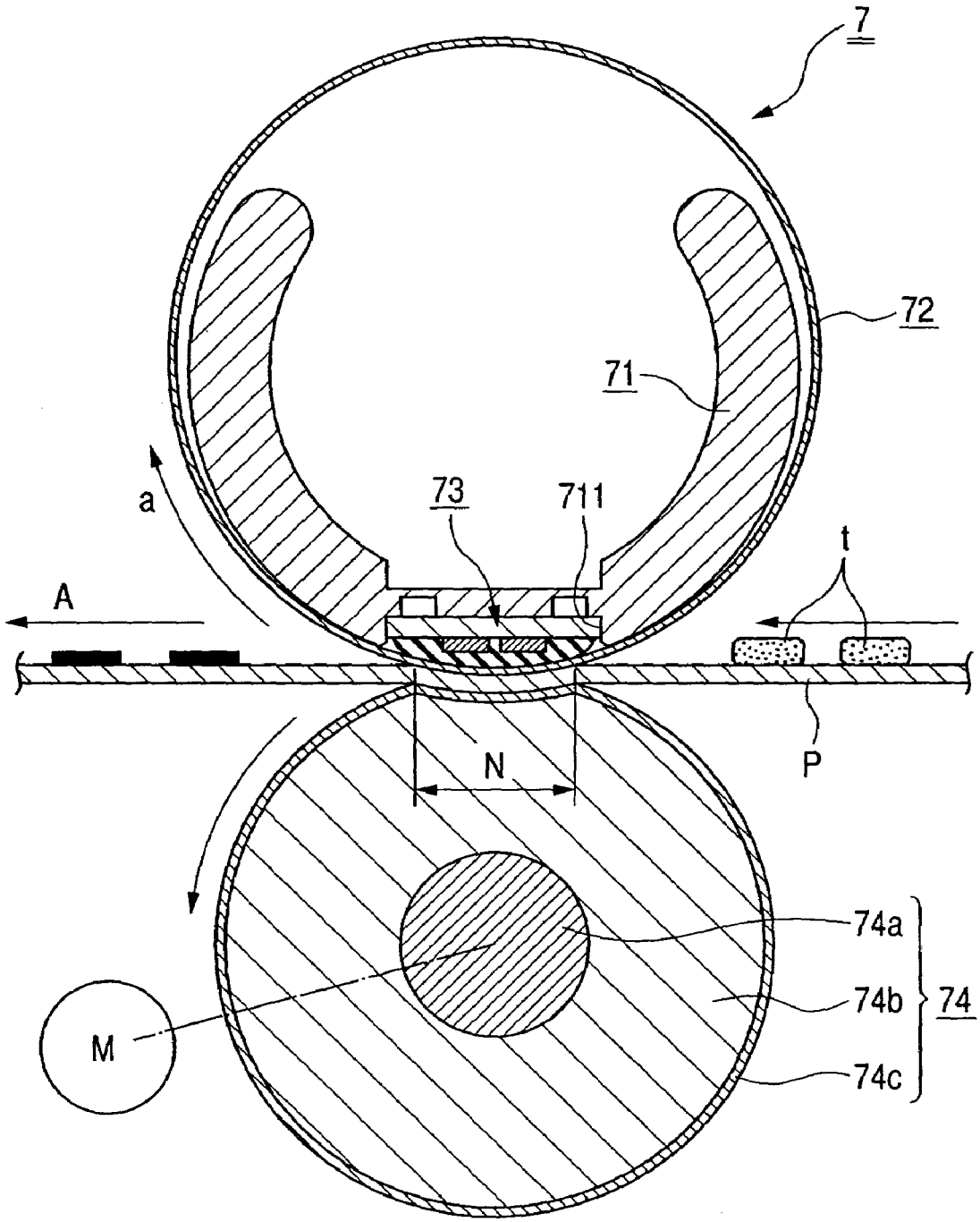
FIG. 2 is an enlarged lateral surface model view of principal portions of an image fixing apparatus.
Figure 3:
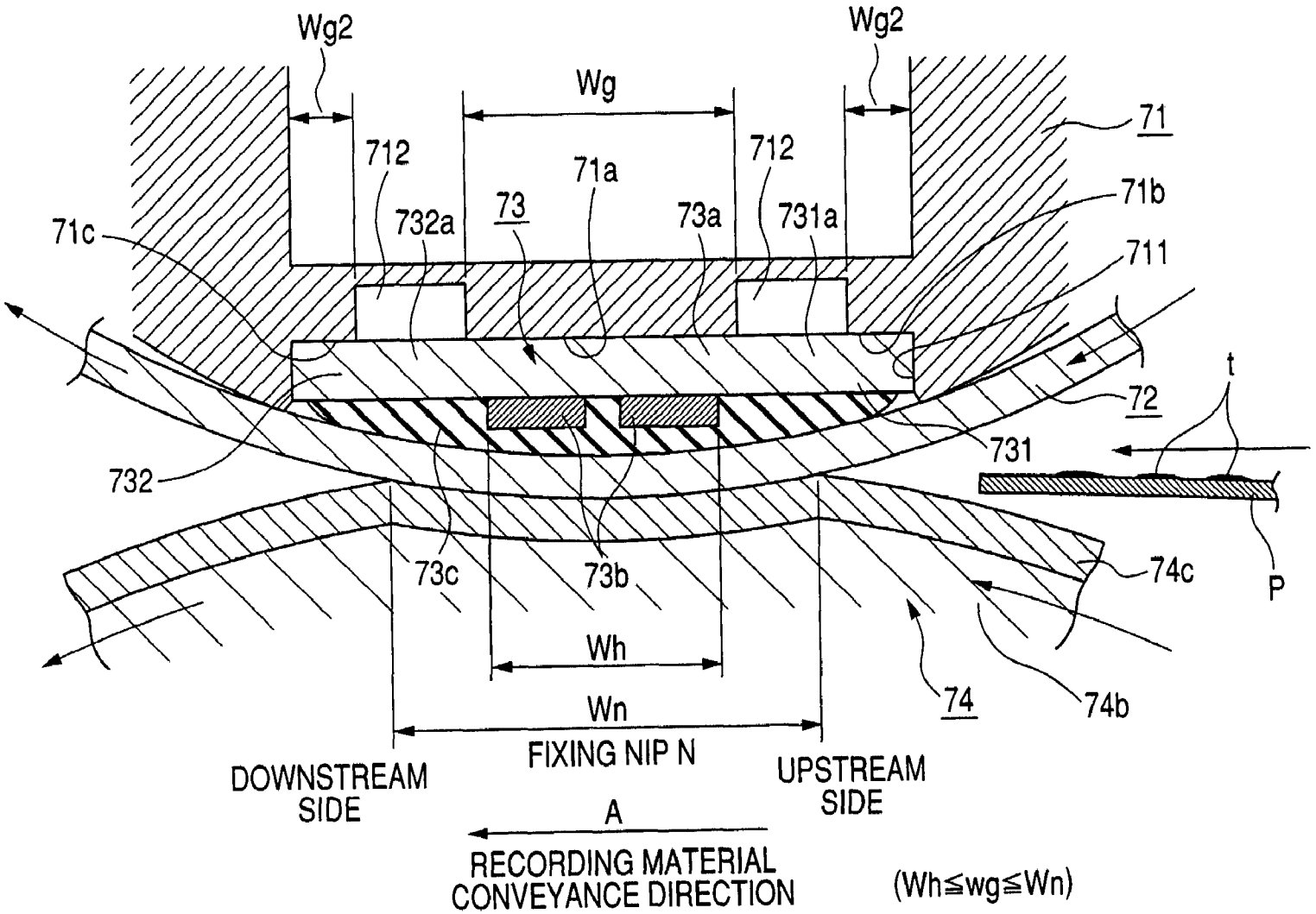
FIG. 3 is an enlarged model view of a fixing nip portion.

FIG. 2 is an enlarged model view of principal portions of the image fixing apparatus 7. FIG. 3 is an enlarged model view of a fixing nip portion. The image fixing apparatus 7 in the first example is a heating apparatus taking a pressurizing roller drive system/tensionless type film heating system.

The numeral 71 represents a heating member support member (heater holder) and is a heat resistive member taking a gutter shape in cross section. A ceramic heating member (heater) 73 is supported by fitting this heater 73 in a grooved portion 711 formed in a longitudinal direction of the support member in an undersurface of this heating member support member 71.

The numeral 72 designates a cylindrical film serving as a flexible member (flexible sleeve) and exhibiting an excellent heat resistivity, and is loosely fitted on the heating member support member 71 that supports the ceramic heating member 73.

Further, a spring (unillustrated) applies a pressure in a direction of the pressurizing roller to both ends of the heating member support member 71 in the longitudinal direction, and a fixing nip portion N is formed by this pressure between the ceramic heating member 73 and the pressuring roller 74. Note that the film 72 is nipped between the ceramic heating member 73 and the pressurizing roller so that an internal surface of the film 72 is brought into contact with the ceramic heating member 73. The recording material P passes through between the film 72 and the pressuring roller 74 at the fixing nip portion N.

The pressuring roller (backup roller) 74 is rotationally driven counterclockwise as indicated by an arrowhead by a driving unit (driving means) M (a pressuring roller driving method). When the pressuring roller 74 is driven, a frictional force at the fixing nip N between the roller 74 and an outer surface of the film 72 causes a rotating force to act on the film 72, and the film 72 rotates while its internal surface is brought into contact with the heating member.

A temperature of the heating member is controlled to keep a predetermined set temperature. The recording material P bearing the unfixed toner image t is passed through the nip portion N of the temperature-controlled fixing unit, whereby the toner image t is fixed by heating onto the recording material P. The recording material P passing through the fixing nip N is curvature-separated from the surface of the film 72 and is discharge-conveyed. The symbol A represents a recording material conveyance direction.

The heating member support member 71 functions as a support member for the ceramic heating member 73 and also performs a role of ensuring rotational conveyance stability of the cylindrical film 72.

The film 72 rotates in the way that the internal surface of the film 72 slides on the undersurface of the ceramic heating member 73 at the fixing nip N and slides on the outer surface of the heating member support member 71 in the vicinity of the fixing nip N. It is required that a frictional resistance among the ceramic heating member 73, the heating member support member 71 and the film 72 be restrained small in order to smoothly rotate the film 72 at low torque. Therefore, a small amount of slide lubricating agent such as a heat resisting grease is interposed between the ceramic heating member 73, the heating member support member 71 and the film 72. This lubricating agent enables the film 72 to slide and rotate smoothly.

The cylindrical heat resisting film 72 takes a thin-film cylinder in which a base layer thereof is polyimide that is, e.g., approximately 30 μm to 100 μm in thickness, and a fluororesin coat of PFA, PTFE, etc. is applied over the base layer through a conductive primer, thus keeping a release property from the toner.

The pressurizing roller 74 is constructed by providing a silicon rubber layer 74*b* as the base layer over a cored bar 74*a* and providing a fluorine-series top layer 74*c* of PFA etc. having a thickness of approximately 10 μm to 100 μm over the silicon rubber layer 74*b* via the unillustrated primer layer, thus keeping the release property from the toner.

Figure 4A:
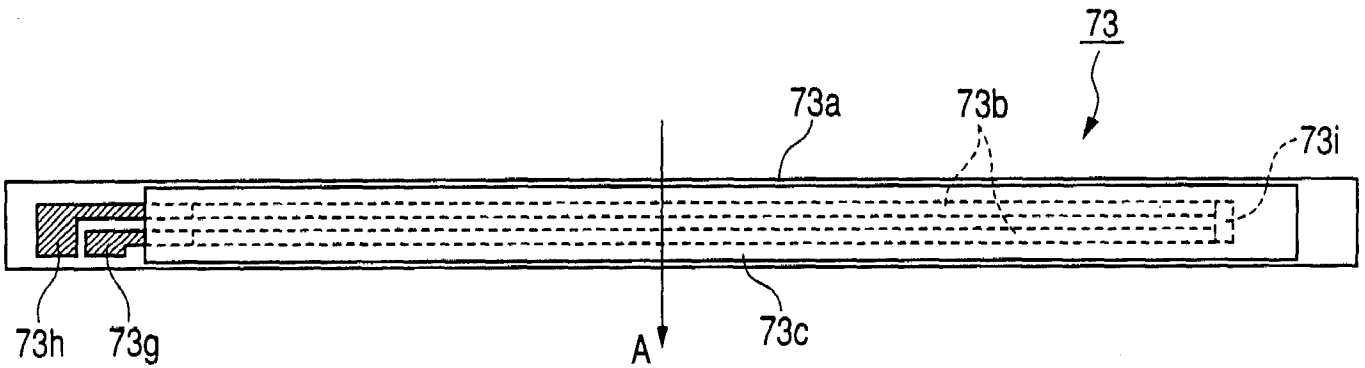
FIGS. 4A, 4B and 4C are explanatory views of a configuration of a heating member.
Figure 4B:
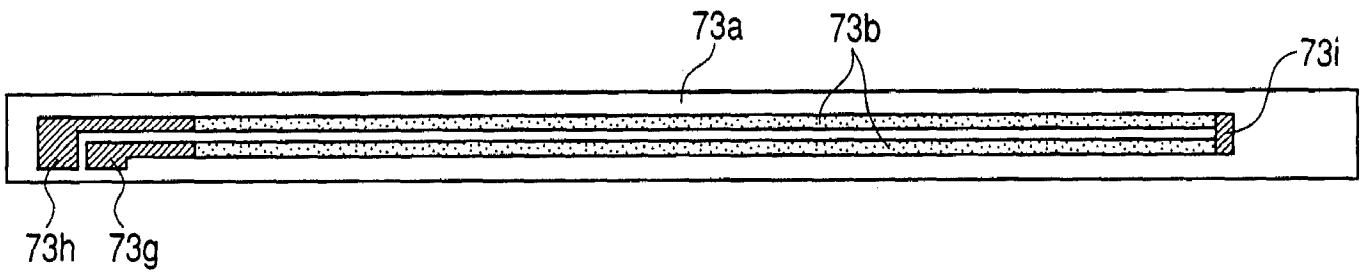
Figure 4C:
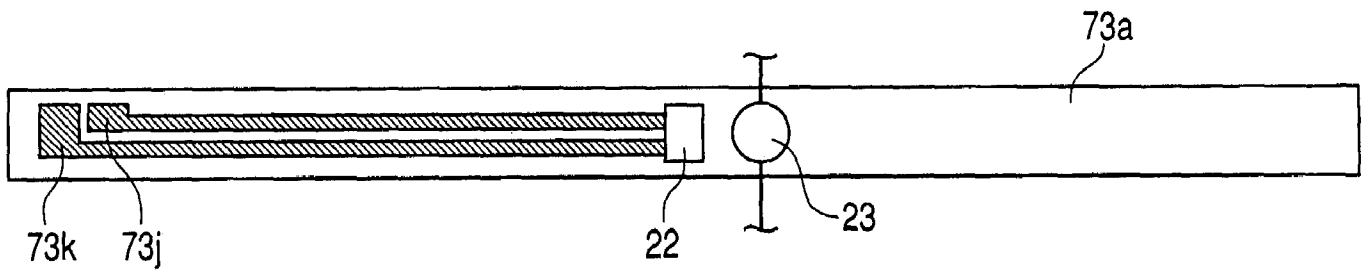

FIG. 4A is a plan model view of the ceramic heating member 73 as viewed on the surface side, FIG. 4B is a plan model view of the ceramic heating member 73 as viewed on the surface side in a state where a surface protective layer is removed, and FIG. 4C is a plan model view of the ceramic heating member 73 as viewed on the rear surface side.

The ceramic heating member 73 is a laterally elongate thin plate member extending long in a direction intersecting (orthogonal to) the recording material conveyance direction. The ceramic heating member 73 involves using, as a substrate, for example, a low thermal capacity ceramic material (alumina in the first example) exhibiting an excellent heat resisting property and electric insulation property such as alumina or alumina nitride that is 270 mm long, 8 mm wide and 1 mm thick. The surface side of the ceramic substrate 73*a* is provided with a heat generating resistor (conducting heat generation body) layer 73*b* of Ag/Pd etc that is pattern-formed by thick-film printing, a surface protective layer 73*c* for covering the heat generating resistor layer 73*b* and power-supply electrode patterns 73*g*, 73*h*, etc. In the ceramic heating member 73 in the first example, two pieces of parallel resistors for heat generation 73*b* are printed in the longitudinal direction of the substrate 73*a*. The power-supply electrode patterns 73*g*, 73*h* are printed on one side ends of the two resistors for heat generation 73*b*, and the other side ends thereof are joined by a conductive pattern 73*i*. Hence, the two resistors for heat generation 73*b* are connected in series. Further, the two resistors for heat generation 73*b* are disposed in symmetry with respect to the center of the ceramic substrate 73*a* in a short direction thereof.

The numeral 22 stands for a temperature detecting unit (temperature detecting means (temperature detecting element)) such as a thermistor. In the first example, the temperature detecting unit is the thermistor and is disposed in the way that the thermistor comes in contact with the ceramic substrate 73*a* in a position corresponding to within a width of a sheet feed area for a minimum-sized recording material on the undersurface side of the ceramic substrate 73*a*.

The symbols 73*j*, 73*k* represent lead current ways (which will hereinafter referred to as thermistor contact points) that electrically conduct to the thermistor 22, and are formed as conductor patterns by the thick-film printing.

The numeral 23 designates a temperature over-rise preventive element (safety device) such as a thermometal cut-out and a temperature fuse. This temperature over-rise preventive element 23 is likewise disposed in the way that the element 23 comes in contact with the ceramic substrate 73*a* in a position corresponding to within the width of the sheet feed area for the minimum-sized recording material on the undersurface side of the ceramic substrate 73*a*.

Figure 5:
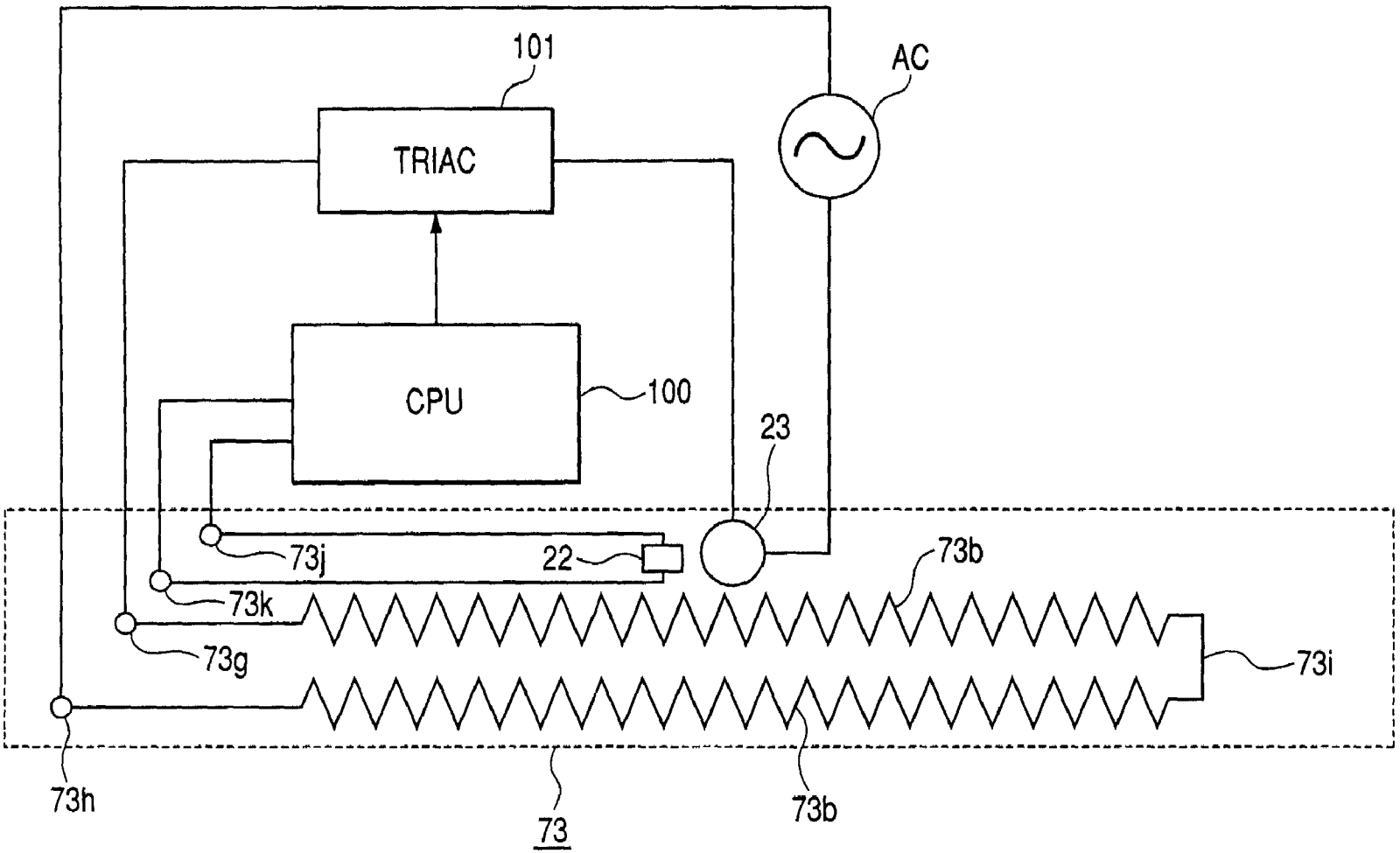
FIG. 5 is a block circuit diagram of a power supply control system for the heating member.

FIG. 5 is a block circuit diagram of a power-supply control system for the ceramic heating member 73. The numeral 100 indicates a control unit (CPU: Central Control Unit). The symbol AC designates a commercial alternate current power source. The numeral 101 represents a TRIAC. Then, a power supply route (an AC line, a primary circuit) is configured to be connected from the power source AC to the temperature over-rise, from the temperature over-rise to preventive element 23, from preventive element 23 to the TRIAC 101, from the TRIAC 101 to the power-supply electrode pattern 73*g*, from the power-supply electrode pattern 73*g* to one heat generating resistor 73*b*, from one heat generating resistor 73*b* to the conductor pattern 73*i*, from the conductor pattern 73*i* to the other heat generating resistor 73*b*, from the other heat generating resistor 73*b* to the power-supply electrode pattern 73*b* and from the other heat generating resistor 73*b* to the power source AC. Then, the control unit 100 controls the supply of the electric power to the heat generating resistor 73*b* by controlling the TRIAC 101.

Furthermore, temperature information of the ceramic heating member 73, which is detected by the thermistor 22, is fed back as a digital signal to the control unit 100 via the thermistor contact points 73*j*, 73*k* (a DC line, a secondary circuit).

The control unit 100 controls the TRIAC 101 on the basis of heater temperature detection information fed back from the thermistor 22, and thus controls the supply of the electric power to the heat generating resistor 73*b* so that the temperature of the heating member is kept at a predetermined target temperature.

The power control by the temperature control unit (temperature control means) with respect to the ceramic heating member 73 involves using a multi-stage power control method such as zero-cross wave count control that controls executing/stopping the electric conduction at an interval of a half-wave of a power source waveform and phase control for controlling a phase angle at which the electric conduction takes place at the interval of the half-wave of the power source waveform.

The temperature over-rise preventive element 23 performs a role of operating due to an over-rise in temperature of the ceramic heating member 73 and urgently cutting off the electric conduction to the heat generating resistor 73*b* in case there occurs a situation (thermal unable control (thermal runaway)) in which the electric conduction to the ceramic heating member 73 uncontrollably consecutively takes place due to a fault of the control unit 100, the TRIAC 101, etc.

Figure 6:
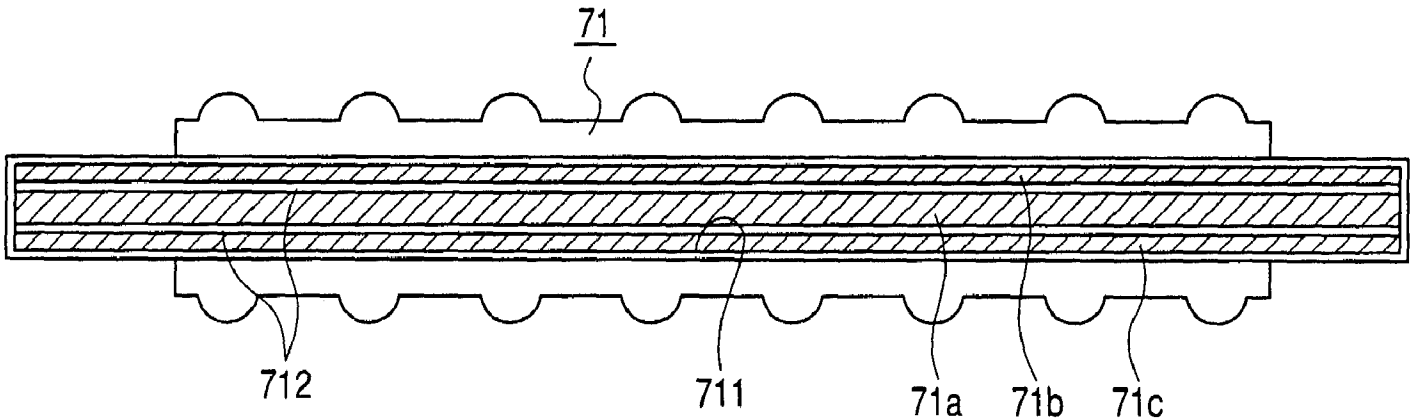
FIG. 6 is a view showing the whole, in a longitudinal direction, of a seating face of a heating member support member in FIG. 3.

FIG. 6 shows a plan view of the heating member support member 71 in the first example as viewed from a seating face side of the ceramic heating member 73. The heating member support member 71 is formed of a high heat resistive resin such as polyphenylene sulfide (PPS), polyamide-imide (PAI), polyimide (PI), polyether-ketone (PEEK) and liquid crystal polymer, which have an adiabatic property, a high heat resisting property and a rigidity, and of a composite material etc. of these resins and ceramics, a metal, a glass, etc.

The rear surface side of the ceramic heating member 73, which is the surface side opposite to the surface side formed with the heat generating resistor 73*b* in the first example, abuts on seating faces 71*a*, 71*b* and 71*c* (oblique-line portions in the Figure) of the bottom face of a heating member fitting groove portion 711 of the heating member support member 71, and the ceramic heating member 73 is then nipped between the fixing nip N and the heating member support member 71 and is thus supported. Air gap portions (taking a hand reeling shape) 712 are disposed between the seating faces 71*a* and 71*b* and between the seating faces 71*a* and 71*c*, respectively. Namely, an area covering the heat generating resistor 73*b* of the ceramic heating member 73 and the vicinity of heating member edges 731, 732 abut on the seating faces 71*m* 71*b* and 71*c*. The seating faces 71*a*, 71*b*, 71*c* and the air gap portion 712 are disposed in the longitudinal direction of the heating member.

A relationship between the ceramic heating member 73, the heating member support member 71 and the fixing nip N will be explained with reference to a cross-sectional view in FIG. 3.

As illustrated in FIG. 3, in the short direction (the recording material conveyance direction) of the ceramic heating member 73, letter Wh be a heat generation resistor disposing area (resistor forming area) of the ceramic heating member 73, Wg be a heating member abutting area of the central seating face 71*a* of the heating member support member 71 and Wn be a recording material conveyance direction area of the fixing nip N, and a disposing relationship in this case is that the resistor forming area Wh is included in the heating member abutting area Wg, and the heating member abutting area Wg is included in the nip portion area Wn ($Wh \leqq Wg \leqq Wn$). Further, a configuration is that upstream and downstream edges 731, 732 of the ceramic heating member 73 in the recording material conveyance direction are disposed outside the fixing nip N, and the air gap portion 712 is provided between the heating member support member 71 and the ceramic heating member 73 so that the support member 71 and the heating member 73 are not brought into contact with each other in areas 731*a*, 732*a* where the heat generating resistor 73*b* is not formed. Namely, the heating member support member (heater holder) 71 includes, in the short direction of the heating member (heater) 73, a contact area Wg opposite to the resistor forming area Wh and coming into contact with the heater 73 and non-contact areas provided on both sides of this contact area Wg and not coming into contact with the heater 73, and the contact area Wg has a width equal to or larger than the resistor forming area Wh. Moreover, the heating member support member further includes second contact areas $W_{g2}$ provided on both sides of the non-contact area and brought into contact with the heating member without being opposite to the resistor forming area Wh.

Figure 7:
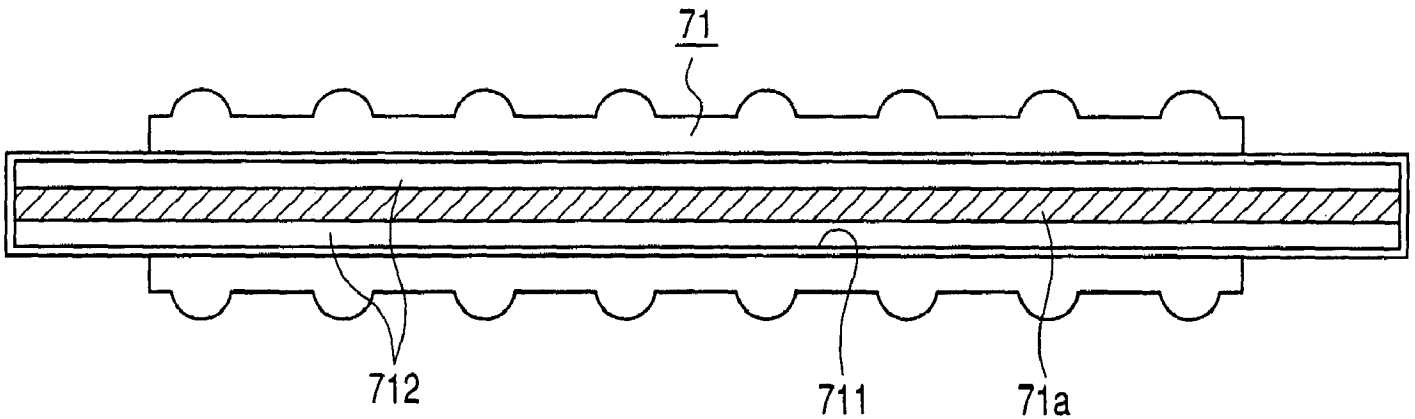
FIG. 7 is a view showing the whole, in the longitudinal direction, of the seating face of the heating member support member in FIG. 8.
Figure 8:
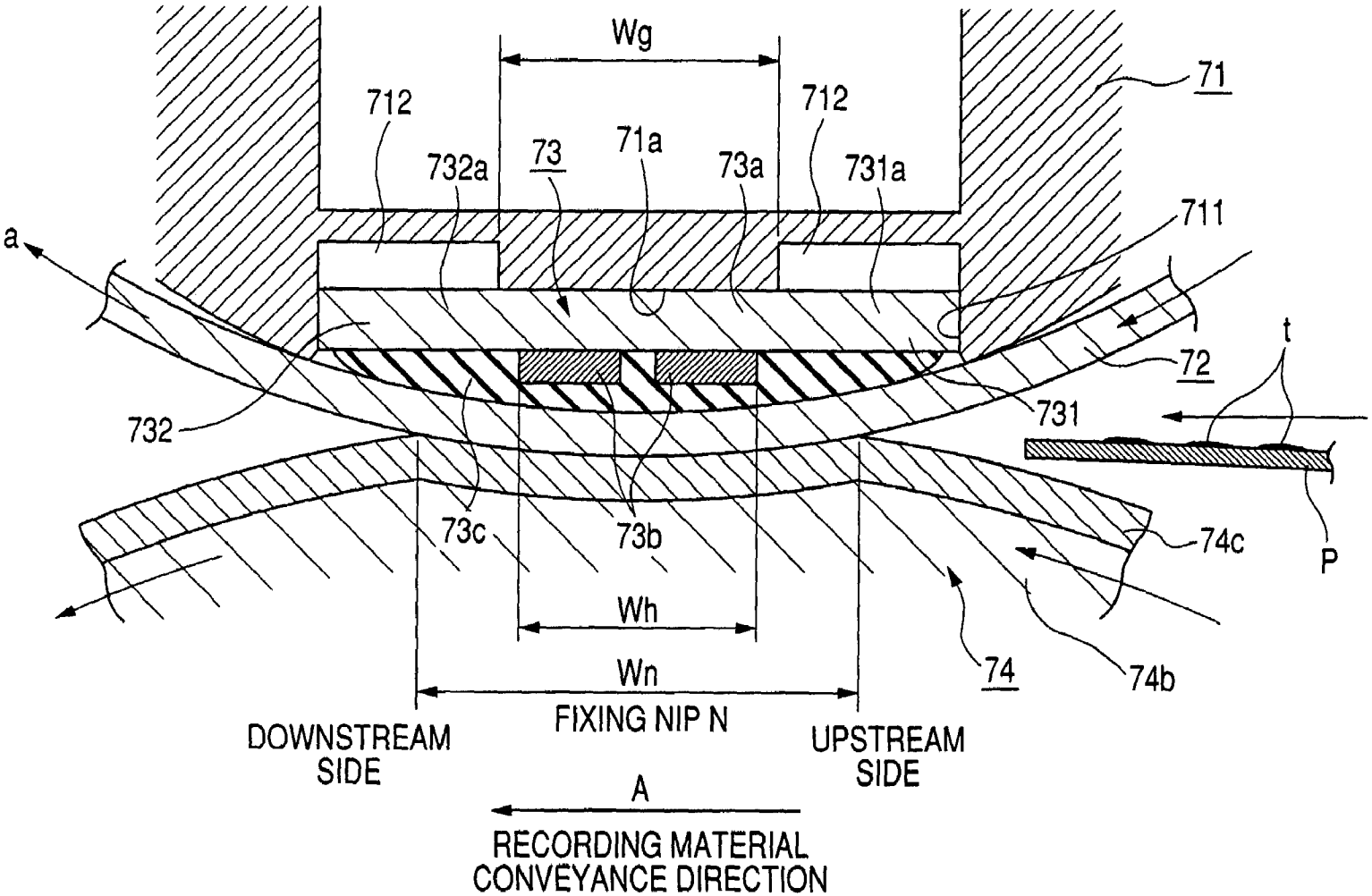
FIG. 8 is an enlarged model view of the fixing nip portion in the case of using the heating member support member in FIG. 7.

FIGS. 7 and 8 show an example in which the heating member support member does not include the second contact area $W_{g2}$, and there is only the seating face 71*a* of the heating member support member 71 that is brought into contact with the ceramic heating member 73. In the case of this configuration also, as in the case of the configurations in FIGS. 3 and 6, the configuration has the relationship such as $Wh \leqq Wg \leqq Wn$.

Moreover, as described above, the temperature over-rise preventive element 23 (FIG. 5) serving as the safety device, which operates due to the heat evolved when in the thermal runaway (thermal unable control) of the ceramic heating member 73, is brought into contact with the rear surface of the heating member, and is constructed to cut off the conducting heat emission to the heat generating resistor 73*b* within a range of the predetermined time when the image fixing apparatus runs away. In the image fixing apparatus employed in the first example, a thermometal cut-out made by Wako Electronics Corp.:CH-16 (a rated operation temperature is 250° C.) is employed, wherein it is known from a preliminary examination that the safety device operates in 5.0±1 sec if running away at the electric power of 1000 W.

Next, a table 1 shows a result of performing a test for verification in the first example. Given herein are the following five patterns of verifying conditions of the image fixing apparatus.

Verification (1)=This is based on the configuration of the heating member support member constructed as in FIG. 3 or 6 in the first example 1.

Verification (2)=This is based on the configuration of the heating member support member constructed as in FIG. 7 or 8 in the first example 1.

Figure 14:
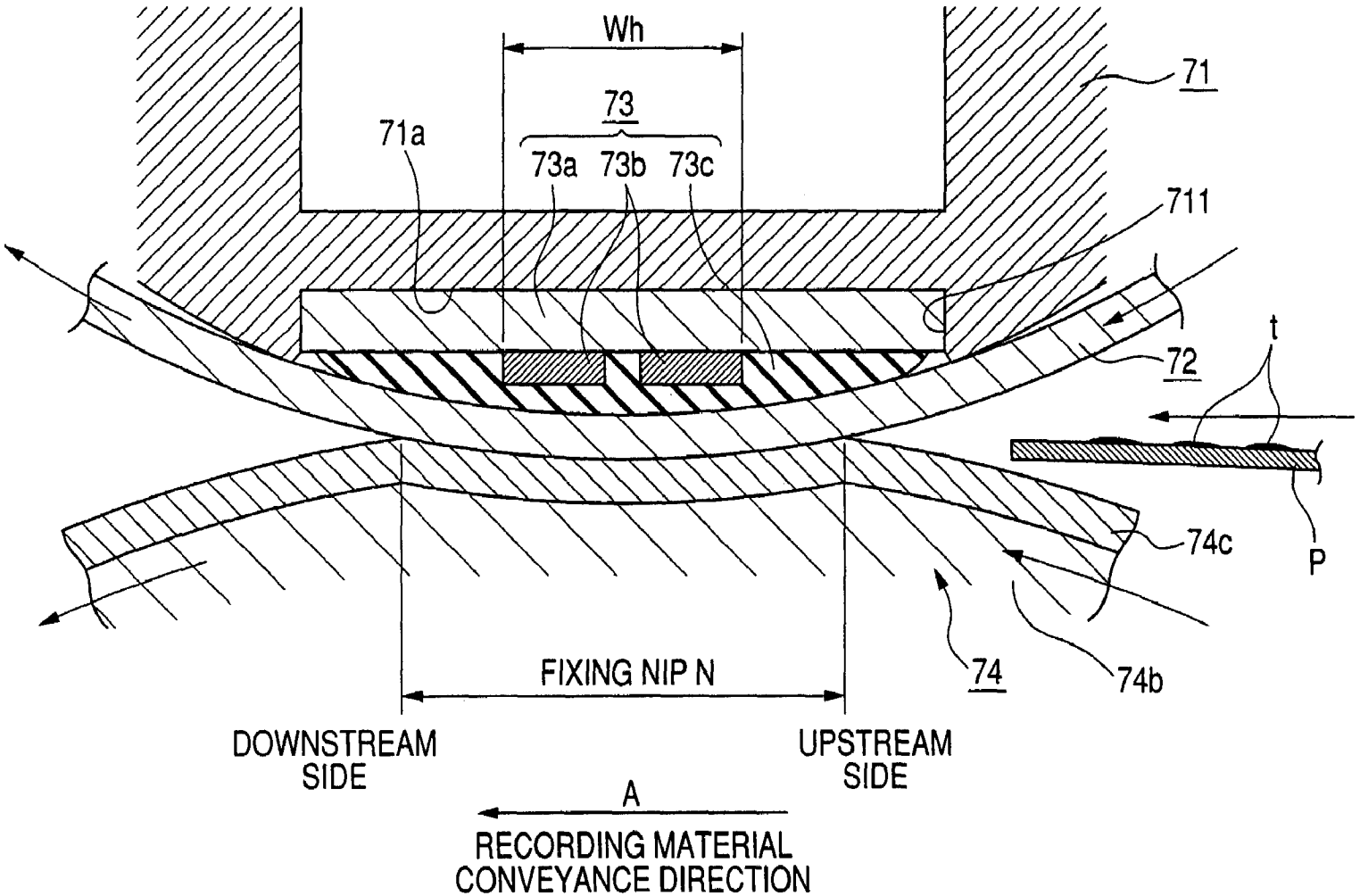
FIG. 14 is an enlarged model view of a fixing nip portion of an image fixing apparatus in a conventional embodiment (3)

Conventional embodiment (3) is based on the configuration of the heating member support member in FIG. 14.

Figure 15:
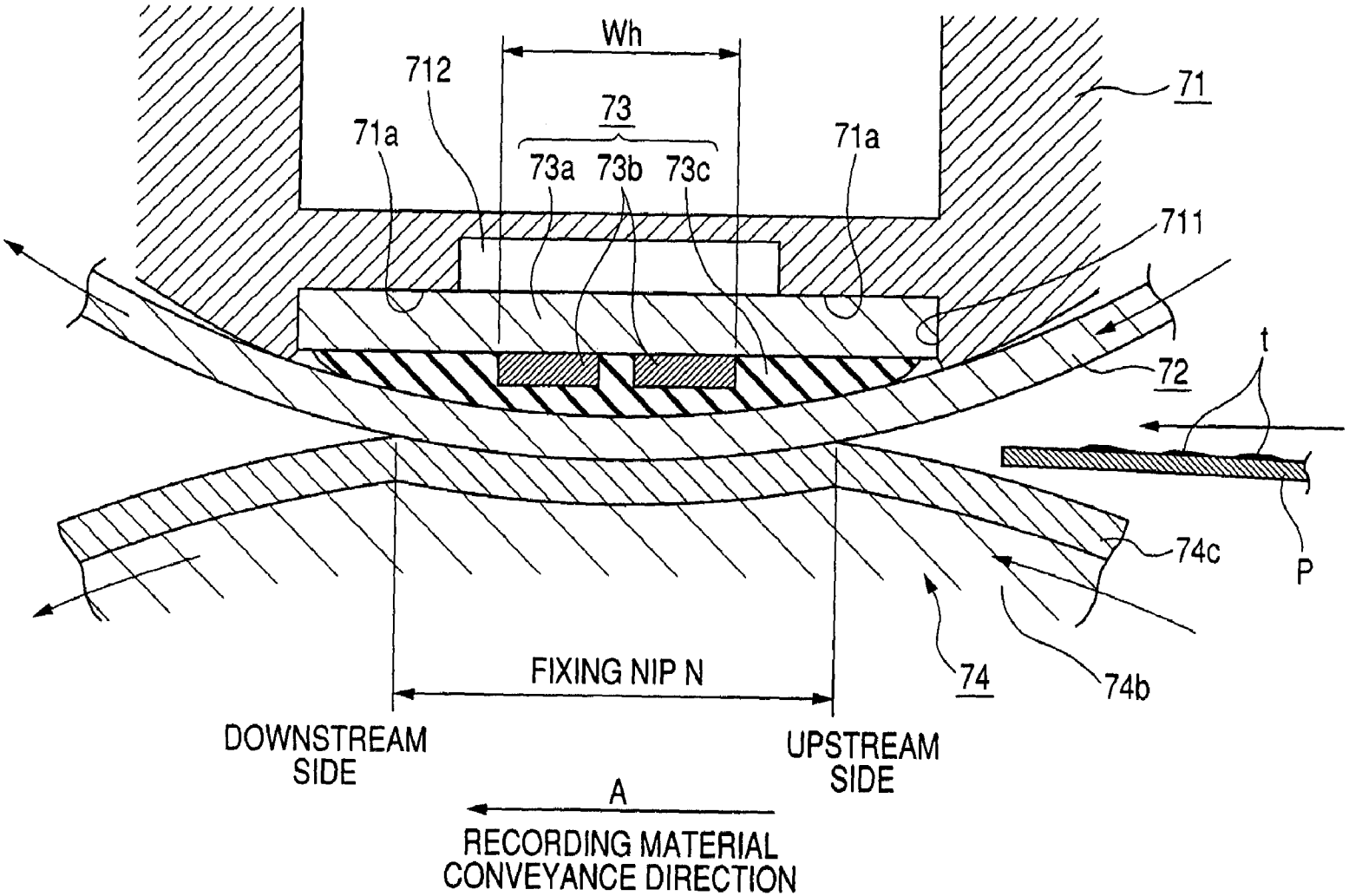
FIG. 15 is an enlarged model view of the fixing nip portion of the image fixing apparatus in a conventional embodiment (4)

Conventional embodiment (4) is based on the configuration of the heating member support member in FIG. 15.

Figure 16:
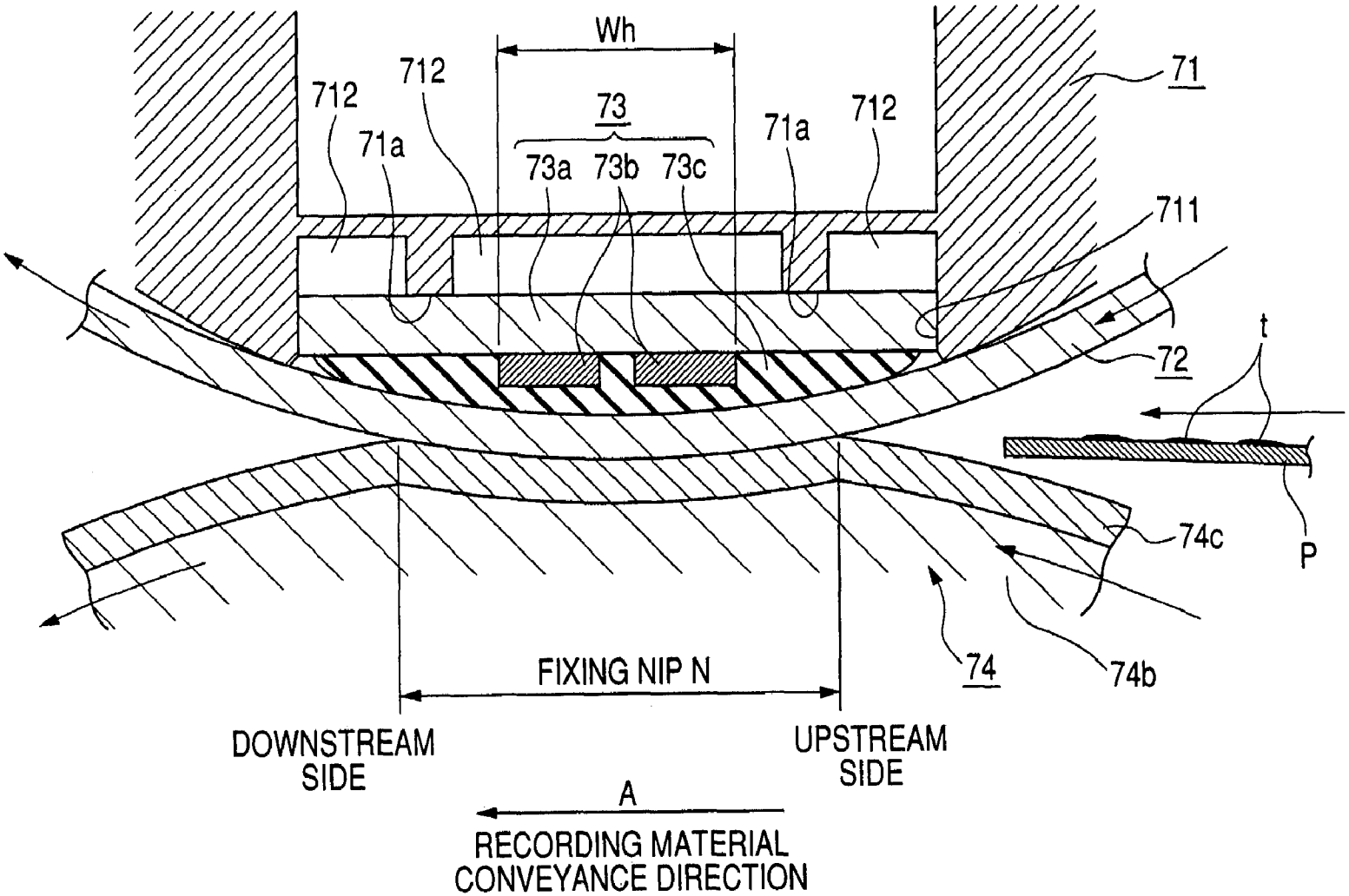
FIG. 16 is an enlarged model view of the fixing nip portion of the image fixing apparatus in a conventional embodiment (5).

Conventional embodiment (5) is based on the configuration of the heating member support member in FIG. 16.

By use of the five patterns of apparatuses, it is examined whether the heating member is damaged or not when running away at the electric power of 1000 W (if damaged, it is the time till the heating member is damaged in a state where there is no safety device), it is examined whether the safety device operates or not at that time (operating time), it is examined whether the heating member is damaged or not when in quintuple conveyance (when a stack of five sheets are conveyed) of small-sized sheets with a basic weight 157 g/m$^2$, and it is compared whether a fixing property is good or poor when the temperature is controlled at a predetermined target temperature.

Figure 9:
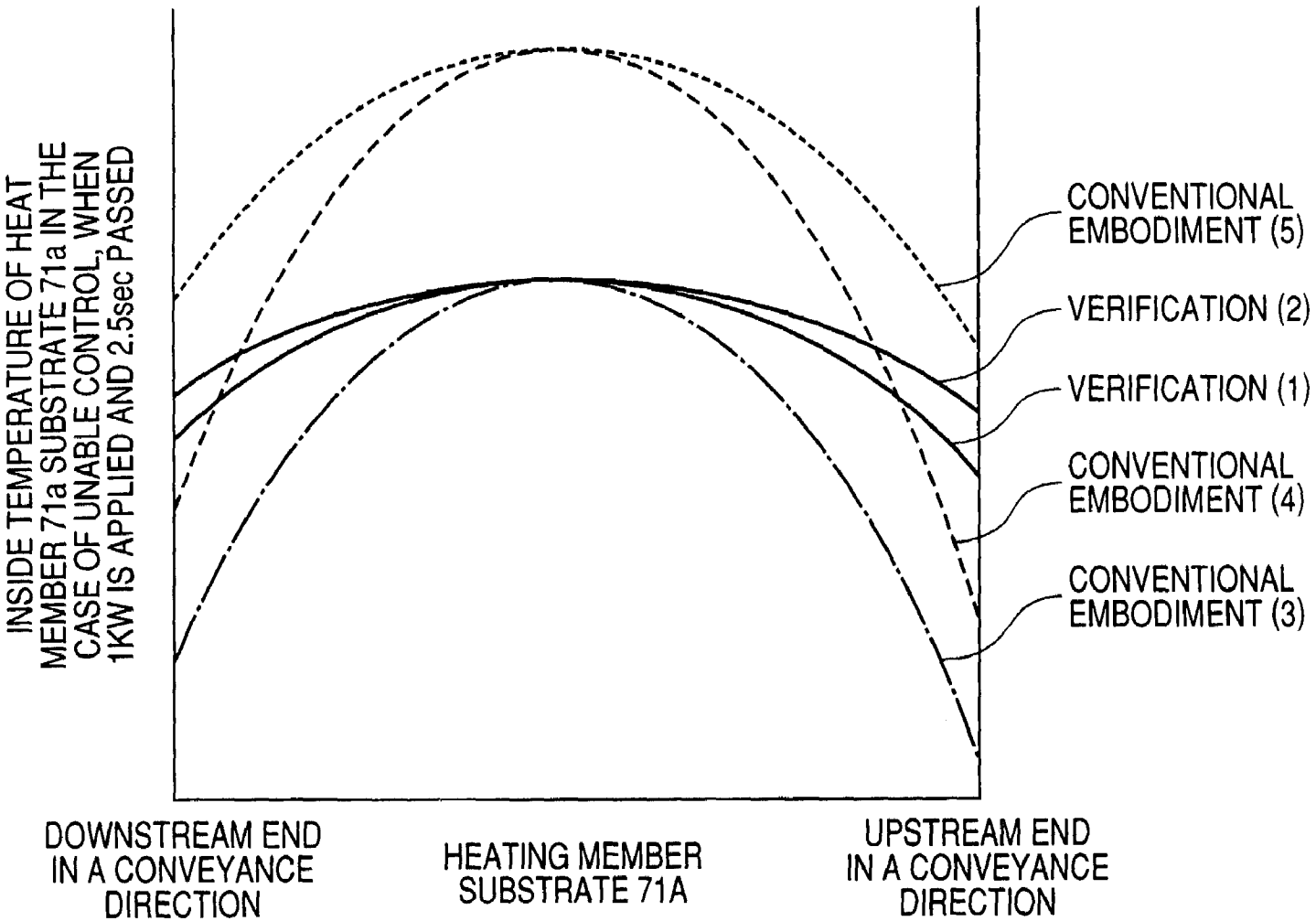
FIG. 9 is a diagram of a temperature distribution within a ceramic substrate of the heating member when runaway (unable control) occurs.

FIG. 9 shows a temperature distribution, in the recording material conveyance direction, of the ceramic substrate 73*a* of the ceramic heating member 73 after 2.5 sec since the start of the runaway with continuous dissipation of the electric power of 1000 W in the five patterns of configurations in the verification (1), the verification (2) and the conventional embodiments (3) through (5) described above. In the verification (1) and the verification (2), the margin to the damage to the heating member is larger by a smaller amount of heat transfer to the heating member support member 71 from the vicinity of the heating member upstream/downstream end portions 731, 732. In the conventional embodiments (3) and (4), there is a large heat transfer to the heating member support member 71 from the non-forming area of the heat generating resistor 73*b*, and hence an internal temperature difference in the ceramic heating member 73 is extremely large. In the conventional embodiment (5), there is a small heat transfer to the heating member support member 71 from the non-forming area of the heat generating resistor 73*b*, however, since the transfer to the resistor forming area Wh is also small, the internal temperature difference in the ceramic heating member 73 does not get so small, and the sufficient margin to the damage to the heating member can not be ensured.

TABLE 1

Table 1: Verification Results in First Example and Conventional Embodiments

| | Verification (1) | Verification (2) | Conventional Embodiment (3) | Conventional Embodiment (4) | Conventional Embodiment (5) |
|---|---|---|---|---|---|
| Damage of Heating Body at Runaway | Undamaged (8.0 sec) | Undamaged (10 sec) | Damaged (4.0 sec) | Damaged (2.5 sec) | Undamaged (5.5 sec) |
| Operation of Safety Device at Runway | Good (4.8 sec) | Good (5.2 sec) | Not-Operating | Not-Operating | No Good (5.1 sec) |
| Damage of Heating Body at Quintuple Conveyance of Small-Sized Sheets | Good | Good | Good | BAD | BAD |
| Fixing Property | Good | Good | No Good | Good | Very Good |

An in-depth description of the result in the table 1 will be given as below.

1. Concerning Damage of Heating Body at Runaway of Image Fixing Apparatus and Operation of Safety Device In the verification (1) and the verification (2), the safety device 23 operates earlier than the damage to the ceramic heating member 73 when the image fixing apparatus runs away, and, besides, there is a sufficient margin (time) up to the damage to the heating member for the time of 0±1.0 sec till the safety device operates. This is because if the ceramic heating member 73 runs away, the heat generating resistor 73*b* continues to emit the heat and rises in temperature, however, the emitted heat transfers to the heating member support member 71 via the heating member seating face 71*a* and to the fixing nip N via the fixing film 72 and further to the areas 731*a*, 732*a* provided with none of the resistors for heat generation within the ceramic heating member 73, and hence the rise in temperature of the resistor forming area Wh of the ceramic heating member 73 is slowed down. Besides, the heat transferring to the areas 731*a*, 732*a* with no heat generating resistor in the ceramic heating member 73 becomes hard to transfer to the heating member support member 71 because of the air gap portion 712 being interposed between the heating member support member 71 and the ceramic heating member 73, and a temperature rising speed of each of the areas 731*a*, 732*a* can follow up with a temperature rising speed of the resistor forming area Wh without a considerable delay. Therefore, in the ceramic heating member 73, a temperature difference between forming area of the heat generating resistor 73*b* and the non-forming area is smaller than in each of the conventional embodiments (3)-(5), and it is considered that a thermal stress load decreases while a margin up to the damage to the heating member increases.

2. Concerning Damage to Heating Body in Quintuple Feeding of Small-Sized Thick Sheets In the verification (1), the verification (2) and the conventional embodiment (3), the damage to the heating member does not occur, and, conversely in the conventional embodiments (4) and (5) where the air gap portion 712 is provided on the side of the heating member support member 71 in the forming area Wh of the heat generating resistor 73*b*, the damage to the heating member occurs. When quintuple-feeding the small-sized thick sheets, an amount of heat radiation in the sheet feeding area of the ceramic heating member 73 becomes extremely large, and the electric power supplied to the heat generating resistor 73*b* gets extremely large for compensating for a decrease in temperature due to this heat radiation. Accordingly, a temperature of the sheet non-feeding portion of which the heat is not absorbed by the sheet due to such an excessive power supply becomes extremely high. Especially in the configurations in the conventional embodiments (4) and (5) where there is the small heat transfer to the heating member support member 71 from the heat generating resistor 73*b*, a temperature rising degree is large. Hence, the heating member support member 71 is easy to solve, then a mechanical stress other than a thermal stress is applied to the ceramic heating member 73, and hence it is considered that the damage to the heating member occurs.

3. Concerning Fixing Property

The fixing property in each of the verifications (1) and (2) is better than in the conventional embodiment (3) and is the same as in the conventional embodiment (4). This is, it is considered, attributed to a result of being drawn from the temperature distribution in the fixing nip N and from a balance of the heat transfer.

Figure 10:
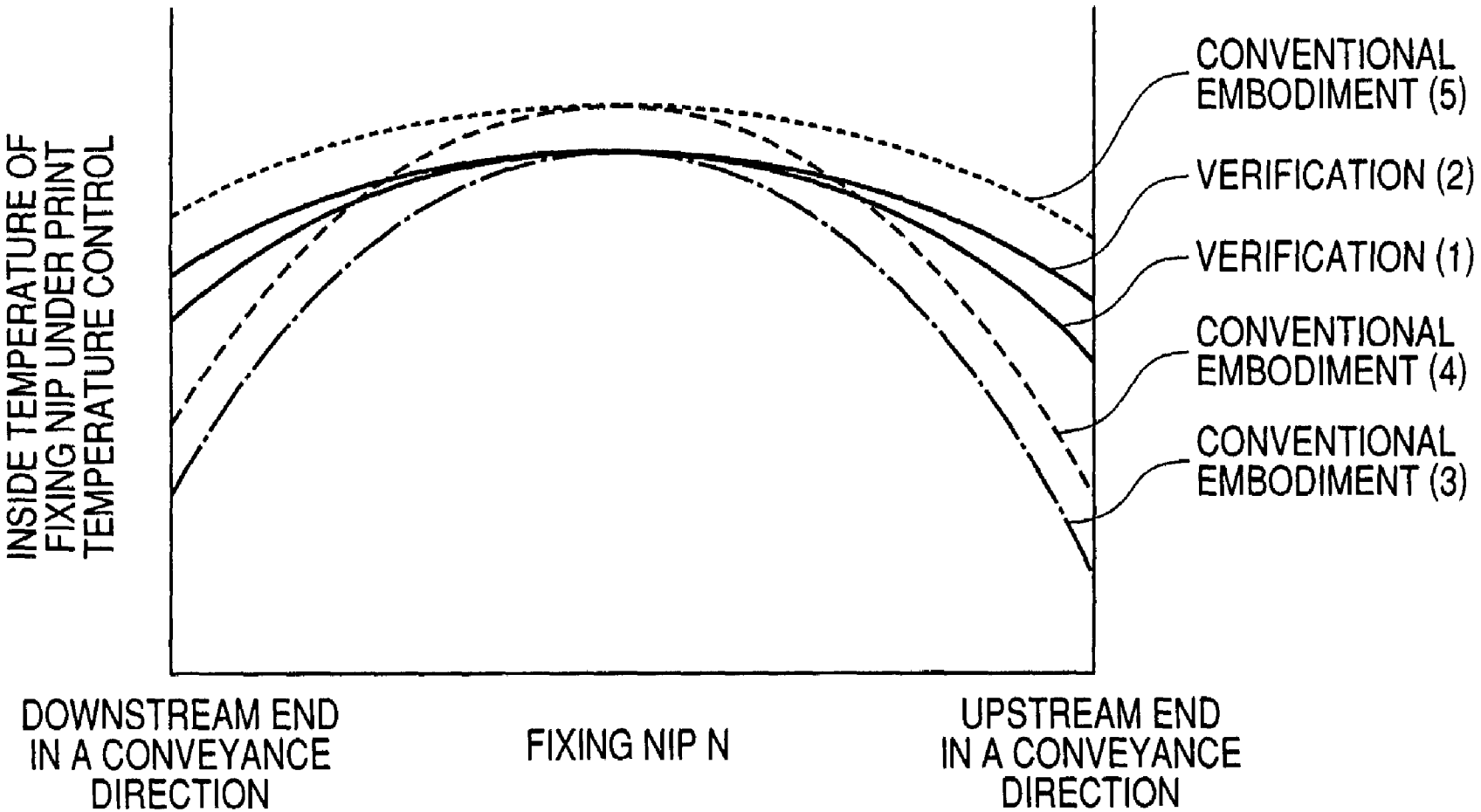
FIG. 10 is a diagram of the temperature distribution within the fixing nip when adjusting the temperature for printing.

FIG. 10 shows a temperature distribution, in the recording material conveyance direction, within the fixing nip N when printing in the configurations in the verification (1), the verification (2) and the conventional embodiments (3) through (5). The verifications (1), (2) and the conventional embodiment (3) are common in terms of such a point that the heat is easy to transfer to the heating member support member 71 on the side of the surface opposite to the heating member from the resistor forming area Wh. In the verifications (1) and (2), however, there is the air gap portion 712 between the ceramic heating member 73 and the heating member support member 71 in the area that is more internal than the upstream/downstream end portions of the fixing nip N, and hence the upstream/downstream end portions of the fixing nip N are kept at a higher temperature than in the conventional embodiment (3). By contrast, the conventional embodiment (3) has no existence of the air gap portion as provided in the verifications (1) and (2), so that there decrease the temperatures of the conveyance-directional upstream side end portion and the conveyance-directional downstream side end portion of the heating member, and the temperature of the fixing nip portion decreases as there decrease the temperatures of the conveyance-directional upstream side end portion and the conveyance-directional downstream side end portion of the heating member. Thus, it is considered that the verifications (1) and (2) exhibit the better fixing property owing to the existences of the air gap portions on both sides of the seating face 71*a* than in the conventional embodiment (3). In the conventional embodiment (4), the heat of the resistor forming area Wh is cut off by the air gap portion on the rear surface side and therefore efficiently transfers to the side of the recording material P, however, an adiabatic effect in the non-forming area of the heat generating resistor 73*b* is small while the temperatures of the upstream/downstream end portions of the fixing nip N are extremely low because of the ceramic heating member 73 being abut-supported by this non-forming area. The temperature at the center of the fixing nip is, however, high, and consequently it is considered that the fixing properties in the verifications (1), (2) and the conventional embodiment (4) become equal. As for the item of the fixing property, the conventional embodiment 5 has a wide adiabatic area and therefore exhibits an extremely good result.

As described above, according to the configuration in the first example, when the image fixing apparatus runs away, the safety device operates in a way that gives the sufficient margin to the damage to the heating member, and the electric conduction can be cut off. Further, the rise in temperature of the sheet non-feeding portion can be moderated even in the case such as when feeding a stack of small-sized thick sheets, and it is possible to ensure the sufficient margin to the damage to the heating member not in the runaway state of the image fixing apparatus but in the normal use. Moreover, the decrease in fixing efficiency can be restrained.

Note that the first example has exemplified only the case of employing alumina for the ceramic substrate of the heating member, however, the same effect is also acquired in the case of using aluminum nitride for the ceramic substrate of the heating member without being limited to alumina.

Second Example

A second example (a verification (6)) involves comparing the margin to the damage to the heating member when the image fixing apparatus runs away by shifting a position of forming the heat generating resistor 73*b* with respect to the central position, in the conveyance direction, of the ceramic heating member 73 in the configuration (FIGS. 7 and 8) in the verification 82) in the first example.

Figure 11:
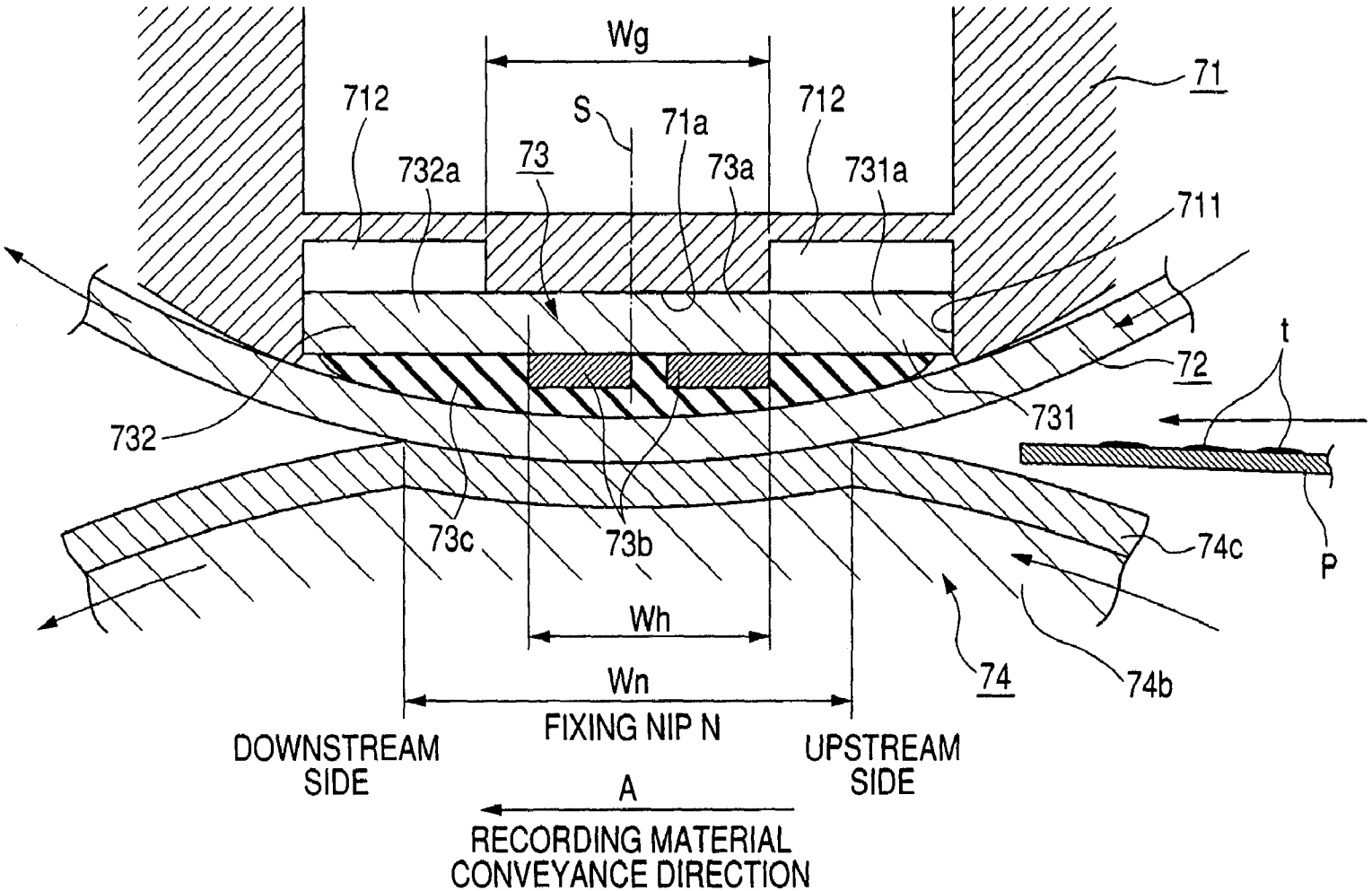
FIG. 11 is an enlarged model view (part 1) of the fixing nip portion of the image fixing apparatus in a second example.
Figure 12:
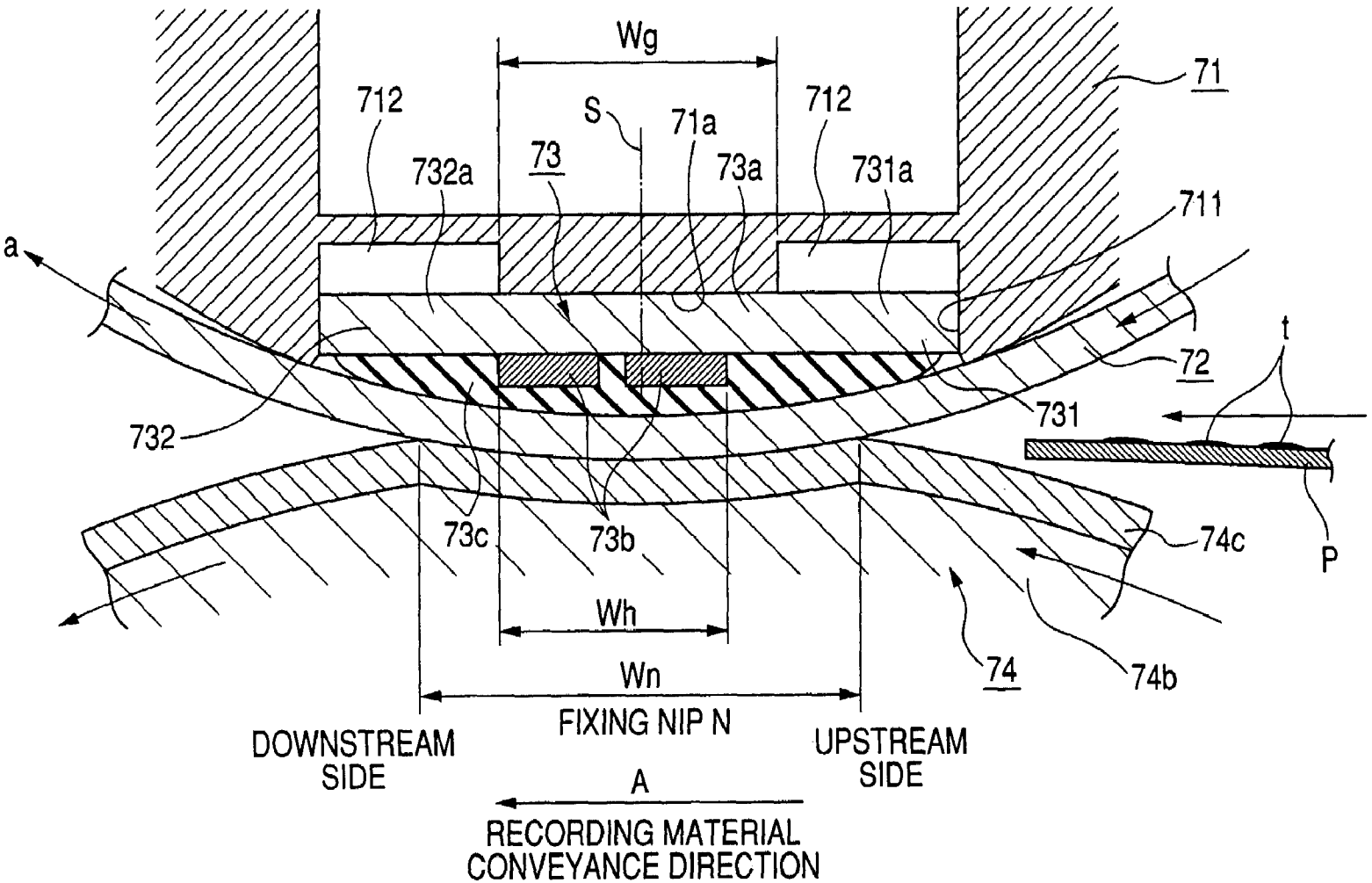
FIG. 12 is an enlarged model view (part 2) of the fixing nip portion of the image fixing apparatus in the second example.

To be specific, in the configuration in the verification (2), the heat generating resistor 73*b* is formed in the position symmetric with respect to the ceramic substrate 73*a*. By contrast, in the configuration of the verification (6) given by way of the second example, as in FIG. 11, the heat generating resistor 73*b* is formed closely to the upstream side in the recording material conveyance direction with respect to the ceramic substrate 73*a*. Further, in a configuration of a verification (7) given by way of the second example, as in FIG. 12, the heat generating resistor 73*b* is formed closely to the downstream side in the recording, material conveyance direction with respect to the ceramic substrate 73*a*. The symbol S represents a short-directional center (a widthwise center of the ceramic substrate) of the ceramic substrate 73*a* of the heating member. The verifications (6) and (7) have the same configuration as the configuration in the verification (2) other than the forming position of the heat generating resistor 73*b* described above.

A table 2 shows results of the verifications in the second example.

TABLE 2

Table 2: Verification Results in Second Example

| | Verification (2) | Verification (6) | Verification (7) |
|---|---|---|---|
| Damage of Heating Body at Runaway | Undamaged (10 sec) | Undamaged (7.0 sec) | Undamaged (7.2 sec) |
| Operation of Safety Device at Runway | Good (5.2 sec) | Good (4.9 sec) | Good (5.0 sec) |
| Damage of Heating Body at Quintuple Conveyance of Small-Sized Sheets | Good | Good | Good |
| Fixing Property | Good | Good | Good |

According to the table 2, both of the verifications (6) and (7) acquire more preferable results owing to the operations and the effects according to the present invention than in the conventional embodiments, however, it is understood that the margin (the time till the heating member is damaged when running away) to the damage to the heating member when running away becomes smaller than in the configuration of the verification (2). This is derived, it is considered, from such a point that the thermal stress applied to the heating member is smaller when the heat generation area is symmetric with respect to the center S of the ceramic substrate 73*a* of the ceramic heating member 73. Accordingly, in terms of the margin to the damage to the heating member when the image fixing apparatus runs away, it is desirable that the forming area of the heat generating resistor 73*b* in the ceramic heating member 73 be formed in a substantially symmetric position with respect to the ceramic substrate 73*a*. More precisely, it is desirable that the heat generation distribution of the heat generating resistor 73*b* be a distribution substantially symmetric with respect to the center S of the ceramic substrate 73*a*.

It is to be noted that the second example has exemplified only the forming area of the heat generating resistor 73*b* with respect to the ceramic substrate 73*a* or only the heat generation distribution, however, without being limited to this forming area or the heat generation distribution, it is desirable in terms of the damage to the heating member that the forming area of the heating member seating face 71*a* of the heating member support member 71 and the forming area of the fixing nip N be formed in positions substantially symmetric with respect to the ceramic substrate 73*a* or the heat generating resistor 73*b*.

Third Example

In the configuration of the verification (2) in the first example, there is the large margin to the damage to the heating member when running away, and the preferable results about the fixing property and the temperature rise of the sheet non-feeding portion, are acquired. In the case of the configuration of the heating member seating face 71*a* in FIGS. 7 and 8, however, a rotation moment is applied to the ceramic heating member 73 when the image fixing apparatus is driven, and there is a possibility that the mechanical stress is applied to the heating member support portion, which is unpreferable in terms of the stable fixing support of the ceramic heating member 73.

Figure 13:
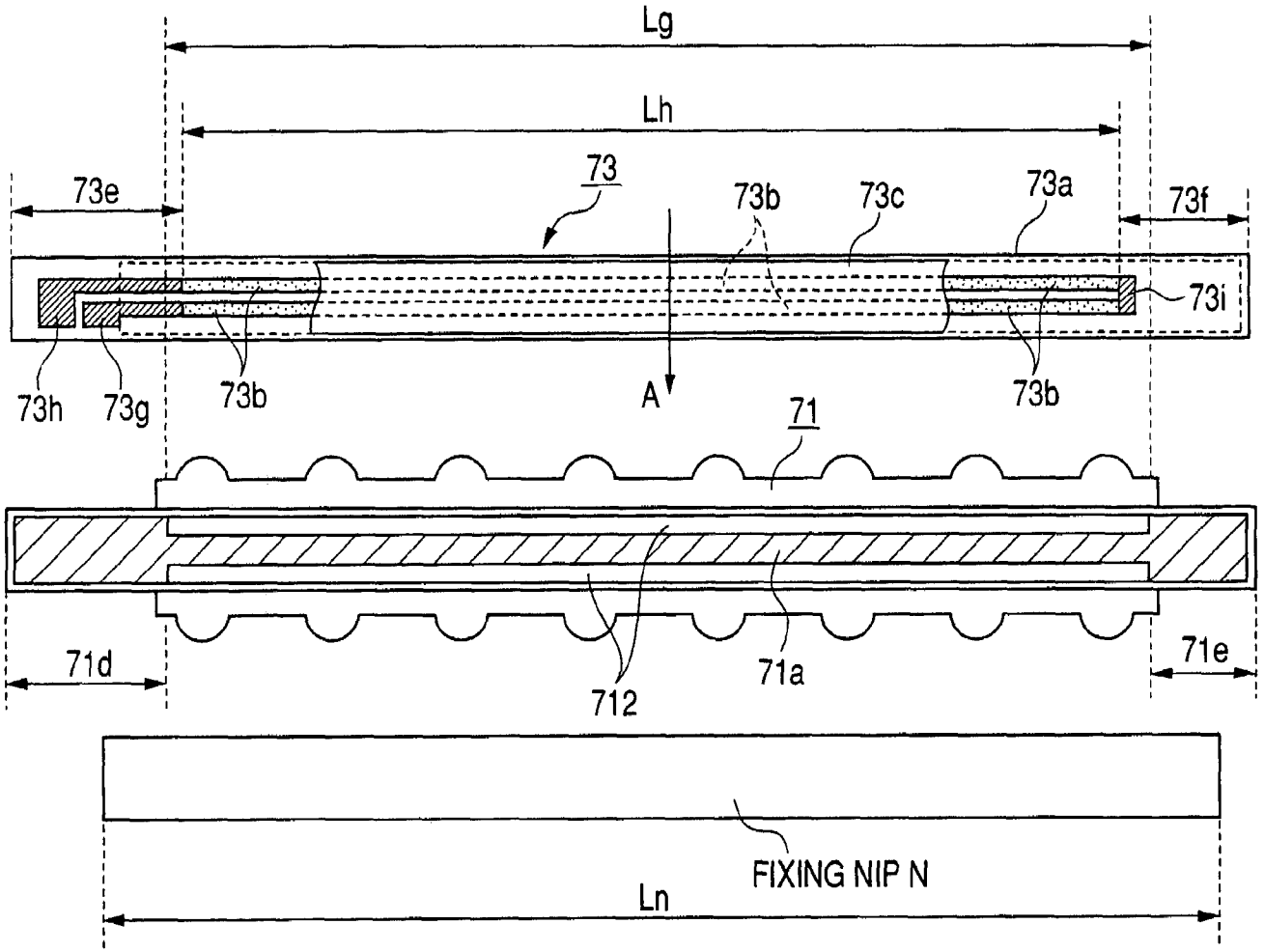
FIG. 13 is an explanatory diagram of a longitudinal position relationship between a heat generating resistor, the seating face of the heating member support member and the fixing nip in a third example.

FIG. 13 shows a structure of the heating member support member 71 in the third example. FIG. 13 illustrates a shape of the seating face of the ceramic heating member 73 in a state where the ceramic heating member 73 is removed, and also illustrates the ceramic heating member 73 in order to clarify a positional relationship with the ceramic heating member 73 in the longitudinal direction. In the third example, in the longitudinal direction of the heating member, the shape of the seating face 71*a* of the heating member support member, which corresponds to a resistor forming area Lh, is the same as the shape in FIG. 8, however, shapes of seating faces of two end portions 71*d*, 71*e* in the longitudinal direction are different from those in FIG. 8. To be specific, a holding width, in the short direction of the heating member, of each of the two end portion areas 71*d*, 71*e* of the seating faces, is wider than a holding width of the central portion area in the longitudinal direction. Further, part of the two end portion areas 71*d*, 71*e* of the seating faces is overlapped with an area Ln of the fixing nip. Namely, let Lh be a longitudinal area of the heat generating resistor 73*b*, Lg be a thin and elongate area of the seating face 71*a* and Ln be a longitudinal area of the fixing nip N, the area Lh is included in the area Lg, and the area Lg is included in the area Ln ($Lh \leqq Lg \leqq Ln$). With this configuration thus taken, it is possible to prevent an inclination of the ceramic heating member 73 even when the rotation moment is applied to the ceramic heating member 73 and to stably support the ceramic heating member on the hating body support member 71. In addition to that, it is feasible to provide the image fixing apparatus capable of ensuring the sufficient margin to the damage to the heating member by taking the shape of the seating face as in the configuration of the verification (2) in the first example in the resistor forming area Wh of the ceramic heating member 73 and of exhibiting the preferable fixing property.

This application claims priority from Japanese Patent Application No. 2004-254282 filed on Sep. 1, 2004, which is hereby incorporated by reference herein.

What is claimed is:

1. An image fixing apparatus comprising:

a heater having a heat generating resistor on a substrate;

a heater holder for holding said heater; and a backup roller for forming a nip portion in cooperation with said heater, wherein said heater holder includes, in a direction along a short side of said heater, a contact area facing a resistor forming area of said heater and coming into contact with said heater, and non-contact areas provided on both sides of the contact area, the non-contact areas facing said heater without contacting said heater, wherein the contact area has a width equal to or larger than the resistor forming area in a direction along the short side of said heater, and wherein the contact area and the non-contact areas in said heater holder overlap a whole of the resister forming area of said heater in a longitudinal direction of said heater.

2. An image fixing apparatus according to claim 1, wherein said heater holder further includes second contact areas not facing the resistor forming area and coming into contact with said heater on both sides of the non-contact area.

3. An image fixing apparatus according to claim 1, wherein said resistors for heat generation are disposed in symmetry with respect to a center in a direction along the short side of said substrate.

4. An image fixing apparatus according to claim 1, wherein said heater holder further includes wider contact areas at both end portions of said heater holder in the longitudinal direction of said heater, the wider contact areas each having a wider contact width in the direction along the short side of said heater than the contact areas facing the resistor forming area.

5. An image fixing apparatus according to claim 4, wherein a part of the wider contact areas exist within an area of the nip portion.

6. An image fixing apparatus according to claim 1, further comprising a flexible sleeve rotating while its internal peripheral surface is brought into contact with said heater, wherein a recording material bearing an unfixed image passes through between said flexible sleeve and said backup roller.

* * * * *

UNITED STATES PATENT AND TRADEMARK OFFICE

CERTIFICATE OF CORRECTION

PATENT NO. : 7,366,455 B2
APPLICATION NO. : 11/213991
DATED : April 29, 2008
INVENTOR(S) : Atsushi Iwasaki et al.

It is certified that error appears in the above-identified patent and that said Letters Patent is hereby corrected as shown below:

ON THE TITLE PAGE

At Item (56), Foreign Patent Documents, "JP 2003282219 A * 10/2003" should read --JP 2003-282219 A * 10/2003--.

COLUMN 1

Line 30, "a unfixed" should read --an unfixed--.
Line 43, "heat-capacity" should read --heat capacity--.
Line 46, "one-surface" should read --one surface--.
Line 64, "disposed oh" should read --disposed on--.

COLUMN 3

Line 2, "that heating" should read --that the heating--.

COLUMN 4

Line 19, "enables," should read --enables--.
Line 21, "extent." should read --extent. However,--.
Line 22, "However," should be deleted and the rest of the line should be moved to line 21.

COLUMN 5

Line 64, "on" should be deleted.
Line 65, "cartridges" should read --cartridge--.

COLUMN 8

Line 11, "Ag/Pd etc" should read --Ag/Pd etc.--.
Line 36, "referred to" should read --be referred to--.

COLUMN 9

Line 54, "71m 71b" should read --71a, 71b--.

COLUMN 11

Line 23, Table 1, "Runway" should read --Runaway--.

UNITED STATES PATENT AND TRADEMARK OFFICE

CERTIFICATE OF CORRECTION

PATENT NO. : 7,366,455 B2
APPLICATION NO. : 11/213991
DATED : April 29, 2008
INVENTOR(S) : Atsushi Iwasaki et al.

It is certified that error appears in the above-identified patent and that said Letters Patent is hereby corrected as shown below:

COLUMN 14
Line 28, “recording,” should read --recording--.
Line 49, Table 2, “at Runway” should be --at Runaway--.

COLUMN 16
Line 4, “hating body” should read --heating body--.
Line 32, “resister” should read --resistor--.

Signed and Sealed this

Seventeenth Day of February, 2009

JOHN DOLL
*Acting Director of the United States Patent and Trademark Office*